US009560944B2

(12) United States Patent
Grey

(10) Patent No.: US 9,560,944 B2
(45) Date of Patent: Feb. 7, 2017

(54) VACUUM CLEANER

(75) Inventor: Nicholas Gerald Grey, Spetchley (GB)

(73) Assignee: GREY TECHNOLOGY LIMITED (GB)

( * ) Notice: Subject to any disclaimer, the term of this patent is extended or adjusted under 35 U.S.C. 154(b) by 898 days.

(21) Appl. No.: 13/994,736

(22) PCT Filed: Dec. 21, 2011

(86) PCT No.: PCT/GB2011/052542

§ 371 (c)(1),
(2), (4) Date: Jun. 16, 2013

(87) PCT Pub. No.: WO2012/085567

PCT Pub. Date: Jun. 28, 2012

(65) Prior Publication Data

US 2013/0291333 A1 Nov. 7, 2013

(30) Foreign Application Priority Data

Dec. 22, 2010 (GB) ..... 1021655.4

(51) Int. Cl.
*A47L 9/12* (2006.01)
*A47L 5/30* (2006.01)
(Continued)

(52) U.S. Cl.
CPC ..... *A47L 5/30* (2013.01); *A47L 9/0411* (2013.01); *A47L 9/12* (2013.01); *A47L 9/122* (2013.01);
(Continued)

(58) Field of Classification Search
CPC ..... A47L 5/30; A47L 9/12; A47L 9/122; A47L 9/325; A47L 9/28; A47L 9/22; A47L 9/0411; A47L 9/1409
(Continued)

(56) References Cited

U.S. PATENT DOCUMENTS 1,829,582 A 10/1931 Carson
2,375,331 A 5/1945 Taylor
(Continued)

FOREIGN PATENT DOCUMENTS

DE 3016965 A1 11/1981
DE 102004041021 B3 8/2005
(Continued)

OTHER PUBLICATIONS

PCT Written Opinion of the International Searching Authority, PCT/GB2014/051737, date of mailing: Aug. 22, 2014, Applicant: Grey Technology Limited.
(Continued)

*Primary Examiner* — David Redding
(74) *Attorney, Agent, or Firm* — Pedersen and Company, PLLC; Ken J. Pedersen; Barbara S. Pedersen

(57) ABSTRACT

This invention relates to a vacuum cleaner (10), and in particular a vacuum cleaner (10) having a rotatable brush (24). The vacuum cleaner (10) has a travelling head (12) adapted to be moved across a surface to be cleaned, the travelling head (12) having a leading end (28) and a trailing end. The travelling head (12) has a rotatable brush (24), the rotatable brush (34) being located in a brush chamber (23) at the leading end of the travelling head (12), the brush chamber (34) having an opening (26) through which a part of the rotatable brush (24) projects, the opening (26) and the rotatable brush (24) spanning substantially the full width of the travelling head (12). The travelling head (12) also has an impeller (46), and a motor (34) for driving the rotatable brush (34) and the impeller (46). The travelling head (12) has a removable dirt-collection chamber (42) spanning substantially the full width of the travelling head, and a filter means (52) located between the dirt-collection chamber (42)
(Continued)

and the impeller (46), the filter means (52) also spanning substantially the full width of the travelling head.

20 Claims, 11 Drawing Sheets

(51) Int. Cl.

| | |
|---|---|
| ***A47L 9/04*** | (2006.01) |
| ***A47L 9/14*** | (2006.01) |
| ***A47L 9/22*** | (2006.01) |
| ***A47L 9/28*** | (2006.01) |
| ***A47L 9/32*** | (2006.01) |

(52) U.S. Cl.
CPC ..... *A47L 9/1409* (2013.01); *A47L 9/22* (2013.01); *A47L 9/28* (2013.01); *A47L 9/325* (2013.01)

(58) Field of Classification Search
IPC ..... A47L 9/12
See application file for complete search history.

(56) References Cited

U.S. PATENT DOCUMENTS

| | | | | |
|---|---|---|---|---|
| 2,867,833 | A | | 1/1959 | Duff |
| 4,905,342 | A | | 3/1990 | Ataka |
| 4,924,548 | A | | 5/1990 | Touya et al. |
| 4,959,885 | A | * | 10/1990 | Sovis ..... A47L 5/34 15/323 |
| 5,452,490 | A | * | 9/1995 | Brundula ..... A47L 9/0477 15/179 |
| 5,590,439 | A | | 1/1997 | Alazet |
| 6,009,594 | A | | 1/2000 | Grey |
| 6,055,701 | A | | 5/2000 | Grey et al. |
| 6,101,668 | A | | 8/2000 | Grey |
| 6,243,912 | B1 | | 6/2001 | Grey |
| 6,949,130 | B1 | | 9/2005 | Grey et al. |
| 6,968,587 | B2 | | 11/2005 | Grey |
| 7,013,521 | B2 | | 3/2006 | Grey |
| 7,017,221 | B1 | | 3/2006 | Grey et al. |
| D554,814 | S | | 11/2007 | Grey |
| 7,331,078 | B2 | | 2/2008 | Grey |
| 7,334,284 | B2 | | 2/2008 | Grey |
| D568,008 | S | | 4/2008 | Grey |
| 7,802,343 | B2 | | 9/2010 | Grey |
| D694,481 | S | | 11/2013 | Grey et al. |
| 2002/0148070 | A1 | | 10/2002 | Tsuchiya et al. |
| 2004/0074027 | A1 | | 4/2004 | Grey |
| 2005/0138764 | A1 | | 6/2005 | Grey |
| 2006/0000040 | A1 | | 1/2006 | Grey et al. |
| 2007/0022563 | A1 | | 2/2007 | Wu |
| 2008/0022485 | A1 | | 1/2008 | Grey |
| 2008/0235897 | A1 | | 10/2008 | Kim et al. |
| 2009/0300873 | A1 | | 12/2009 | Grey |
| 2014/0304938 | A1 | | 10/2014 | Grey |

FOREIGN PATENT DOCUMENTS

| | | | |
|---|---|---|---|
| DE | 202011051194 | U1 | 2/2013 |
| EP | 0232761 | A2 | 8/1987 |
| EP | 0847721 | A2 | 6/1998 |
| EP | 2215947 | A2 | 8/2010 |
| GB | 1276402 | | 6/1972 |
| GB | 2269475 | A | 2/1994 |
| JP | S55124237 | U | 9/1980 |
| JP | H03237949 | A | 10/1991 |
| JP | 2004337427 | A | 12/2004 |
| JP | 2006312066 | A | 11/2006 |
| WO | WO0150935 | A1 | 7/2001 |
| WO | 2006/131706 | A1 | 12/2006 |
| WO | 2014/195711 | A1 | 12/2014 |

OTHER PUBLICATIONS

PCT International Search Report, PCT/GB2014/051737, date of mailing: Aug. 22, 2014, Applicant: Grey Technology Limited.
GB Examination Report, Application No. GB1420520.7, date of report: Jan. 27, 2015, Applicant: Grey Technology Limited, Intellectual Property Office, UK.
GB Examination Report, Application No. GB1420520.7, date of report: Jun. 3, 2015, Applicant: Grey Technology Limited, Intellectual Property Office, UK.
Search Report, in corresponding Application No. GB1406139.4, Grey Technology, date of search: Oct. 6, 2014.
PCT International Search Report for PCT/GB2011/052542, mailed Mar. 29, 2012, applicant: Grey.
Search Report for GB1021655.4, reported Apr. 21, 2011, applicant: Grey, Intellectual Property Office, UK.
Translation of German Patent DE 10 2004 041 021 B3.

* cited by examiner

VACUUM CLEANER

FIELD OF THE INVENTION

This invention relates to a vacuum cleaner, and in particular a battery-powered vacuum cleaner including a rotatable brush.

In the following description, directional and orientational terms such as "top", "bottom" etc. refer to the vacuum cleaner in its normal orientation of use upon a substantially horizontal surface 36, as shown for example in FIGS. 1, 2, 5 and 6. It will be understood, however, that the vacuum cleaner can be used in other orientations.

BACKGROUND TO THE INVENTION

Vacuum cleaners have a motor which typically drives an impeller to create a flow of air. The travelling head of the vacuum cleaner has an opening in its bottom wall through which air can enter the travelling head, the air carrying dirt and debris into the travelling head. It is arranged that the air transports the dirt and debris by way of ducts within the travelling head, the ducts typically having a cross-sectional area measuring around 7 to 10 $cm^2$. The dirt and debris is transported through the ducts to a dirt-collection chamber. The air then passes through one or more filters before leaving the vacuum cleaner, the filters being arranged to trap the dirt and debris within the dirt-collection chamber for subsequent disposal.

The dirt-collection chamber can contain or comprise a disposable bag, the wall of the bag also acting as a filter. Alternatively, the dirt-collection chamber is a receptacle which can be removed from the vacuum cleaner, emptied, and re-installed into the vacuum cleaner for re-use.

Many vacuum cleaners have a rotatable brush located adjacent to the opening of the travelling head. The brush is rotated and engages the surface which is being cleaned. The brush helps to dislodge dirt and debris from the surface which is then gathered into the air flow and transported to the dirt-collection chamber.

A disadvantage of traditional vacuum cleaners is that some of the dirt and debris which has been dislodged by the rotating brush falls back or is brushed back onto the surface before it is gathered by the air flow.

A further disadvantage is that larger debris can be pushed along by the leading edge of the travelling head rather than being collected. This disadvantage is caused by the close proximity of the bottom of the leading edge to the surface being cleaned.

A further disadvantage is that larger debris that is collected can lodge in the ducts and block the vacuum cleaner.

Many vacuum cleaners are mains powered, and the manufacturers of mains powered vacuum cleaners will often seek to maximise the electrical and suction power of their vacuum cleaners in an attempt to increase their marketability. Typically, the opening of the travelling head is surrounded by a wall which permits a relatively small air flow into the travelling head. The air is forced to pass underneath the wall, through the underlying carpet or other floor covering, whereby to dislodge dirt and debris from between the fibres of the carpet. As impellers are typically 10 to 40% efficient in use and air is not particularly good at dislodging dust, dirt and debris, this is a relatively inefficient method of cleaning. In order to achieve higher impeller efficiencies, manufacturers have tended to develop faster spinning impellers creating higher suction. However, as it is air flow rather than suction which dislodges dirt and debris, such vacuum cleaners generally do not achieve improved dirt and debris collection efficiency. Manufacturers have therefore tended to quote electrical and suction power as a measurement of effectiveness of their appliances rather than cleaning efficiency.

It is also known to provide battery-powered vacuum cleaners. Battery-powered vacuum cleaners employing this traditional approach cannot provide the suction power of a mains powered vacuum cleaner without prejudicing the operating cycle of the vacuum cleaner, i.e. without unacceptably shortening the period between battery recharging, and therefore do not provide comparable cleaning performance.

It is an aim of the manufacturers of most domestic vacuum cleaners (mains powered and battery powered), that the travelling head has a height which allows the user to clean underneath chairs, cupboards and the like. The inventor considers a reasonable height limit to be 90 mm.

It will be understood that vacuum cleaners are not the only form of surface cleaning apparatus, and "carpet sweepers" are known which do not utilise suction. Carpet sweepers typically have a travelling head with an opening adjacent to the leading edge. A rotatable brush is mounted in the travelling head, the brush having bristles which project from the opening. The brush may be rotated by way of gearing connected to the wheels of the travelling head, so that movement of the travelling head across the surface being cleaned causes the brush to rotate. Alternatively, some carpet sweepers have a motor to rotate the brush. Carpet sweepers rely upon the mechanical dislodgement of dirt and debris from the surface being cleaned by the rotating brush. Only dirt and debris which is lifted from the surface and pushed into a dirt-collection chamber will be captured by the carpet sweeper, and some of the dirt and debris which is dislodged falls back onto the surface. Whilst the rotating brush generates air currents within the travelling head those air currents are incidental and do not significantly assist the cleaning operation, i.e. the air currents are turbulent and do not carry a significant amount of dirt and debris from the surface being cleaned and into the dirt-collection chamber.

Self-propelled or robotic vacuum cleaners are also known, and many have one or more rotating brushes to dislodge dirt and debris. The known robotic vacuum cleaners are substantially circular in plan view, which is necessary to reduce the likelihood that the vacuum cleaner will collide with, and perhaps become stuck by, articles of furniture and the like. However, the requirement to fit the componentry into the circular housing compromises the cleaning efficiency, with the shape of the air flow duct in particular having to be restricted to fit within the housing. On the other hand, most vacuum cleaners, and most carpet sweepers, are substantially rectangular in plan view, as this usually represents the most efficient shape in terms of packaging and performance.

Many prior art vacuum cleaners have a relatively long and tortuous path between the opening in the travelling head and the dirt-collection chamber. The intention is generally to maintain a high air speed through the travelling head so as to keep the dirt and debris entrained within the air flow. Also, a more tortuous path reduces the likelihood that dirt and debris will fall back out of the vacuum cleaner, particularly after the air flow has been stopped.

SUMMARY OF THE INVENTION

The present invention seeks to provide an improved vacuum cleaner which has particular benefits for a lower power-consuming or battery-powered vacuum cleaner.

According to the present invention there is provided a vacuum cleaner having a travelling head adapted to be moved across a surface to be cleaned, the travelling head having a leading end and a trailing end, the travelling head having:

a rotatable brush, the rotatable brush being located in a brush chamber at the leading end of the travelling head, the brush chamber having an opening through which a part of the rotatable brush projects, the opening and the rotatable brush spanning substantially the full width of the travelling head;

an impeller;

a motor for driving the rotatable brush and the impeller;

a removable dirt-collection chamber spanning substantially the full width of the travelling head;

a filter means located between the dirt-collection chamber and the impeller, the filter means also spanning substantially the full width of the travelling head;

and an air flow duct connecting the brush chamber to the dirt-collection chamber, the leading end of the air flow duct being substantially tangential to the rotatable brush, the air flow duct spanning substantially the full width of the travelling head throughout the whole length of the air flow duct.

Surprisingly, in tests conducted by the inventor upon embodiments of the present invention, it has been shown to be possible to achieve dirt collection efficiencies higher than current mains powered vacuum cleaners, whilst using less than 10% of their electrical power.

The significant advance in dirt collection efficiency is presently understood to be due at least in part to the air flow duct being substantially full-width and tangential to the rotatable brush, whereby the momentum imparted to the dirt, debris and air by the rotatable brush can significantly increase the percentage of dirt and debris transferred to the dirt-collection chamber. The avoidance of any substantial restrictions within the air flow duct is also believed to contribute to the significant efficiency improvement, as do also the substantially full-width dirt-collection chamber and the substantially full-width filter, which help to promote smooth air flow through the travelling head. The present invention therefore does not restrict the air flow duct or otherwise seek to increase the speed of the air flowing through the duct, but instead seeks to maximise the size of the duct so as to keep the air flow as smooth as possible.

The cross-sectional area of the duct is preferably a significant proportion of the cross-sectional area of the dirt-collection chamber. In a conventional vacuum cleaner for example the air may pass through a duct having a cross-sectional area of 7-10 $cm^2$ and enter a dirt-collection chamber having a cross-sectional area of 300 $cm^2$—this significant change in cross-sectional area results in a significant change of air speed and in substantial turbulence. In the present invention the change in cross-sectional area between the air flow duct and the dirt-collection chamber is much lower, ideally substantially less than 100% and preferably no more than 25%. The air flow through the opening in the travelling head, through the air flow duct and through the dirt-collection chamber can therefore be much smoother and therefore more efficient, and the dirt and debris which are entrained in the air flow fill the container in a progressive way, the fluff and debris itself acting as a filter as it builds up at a low density facilitating a consistent flow of air, when compared to traditional methods where dirt tends to tightly pack around the filter due to the high suction.

The cross-sectional area of the air flow duct is increased by its greater width (i.e. by its greater dimension across the width of the travelling head), and the cross-sectional area is optimised to capture the momentum of the dirt and debris dislodged by the brush while maintaining a substantially linear flow of air from adjacent to the brush into the dirt-collection chamber. Also, restrictions within the duct are avoided or minimised. An advantage of optimising the cross-sectional area of the air flow duct is that the duct is significantly less likely to become blocked by larger debris collected by the apparatus. As with all vacuum cleaners, the air flow duct is required to control the air currents within the travelling head; the present inventor has appreciated that it is advantageous to optimise the cross-sectional area of the air flow duct within the limitations imposed by the dimensions of the travelling head.

Desirably the dirt-collection chamber is positioned substantially adjacent to the rotating brush so that the air flow duct is relatively short. Preferably, the length of the air flow duct is less than the diameter of the rotatable brush. Desirably also the air flow duct is relatively linear so that the changes in direction of the air flow within the duct are minimised and smooth. Minimising the length of the air flow duct, and also minimising the deviation which the air flow must undertake, reduces the likelihood that any entrained dirt or debris will drop out of the air flow before reaching the dirt-collection chamber.

Desirably, a small gap can be employed between the bottom of the leading edge of the travelling head and the surface to be cleaned. This serves to direct the flow of air tangentially towards the rotating brush and assists with the collection of larger debris.

Desirably, a relatively large percentage of input power is deployed by way of the rotatable brush. Traditional vacuum cleaners deploy less than around 15% of their power by way of the rotatable brush. With the disclosed arrangement, cleaning efficiency is enhanced by deploying around one third of the available power by way of the rotatable brush and two thirds by way of the impeller. Also, the impeller is driven to rotate relatively slowly, whereby the arrangement utilises a relatively high air flow and relatively low suction. Whilst such an arrangement might not be considered to be efficient at converting electrical power into 'suction watts', it can be shown to be extremely efficient at converting electrical power into cleaning effectiveness.

Desirably the bristles of the brush are aligned in two helical rows upon the brush hub. Ideally the two helical rows are diametrically opposed around the brush hub. Preferably, the bristles in one of the helical rows are significantly stiffer than the bristles in the other of the helical rows.

The use of bristles of differing stiffness has particular advantages. Softer, finer bristles give an enhanced dust removal on hard floors, whereas stiffer bristles give improved agitation to carpets—utilising soft and hard bristles enables the vacuum cleaner to be effective upon both of these surfaces. Also, having bristles with different stiffness on different parts of the hub, and in particular upon opposite sides of the hub, creates a vibrating/beating effect which serves to lift dust from deep within the pile of a carpet enabling it to be collected by the passing air flow.

Preferably, the top of the air flow duct is defined by an upper wall which projects into the dirt-collection chamber. This helps to create a progressive delivery of dirt into the dirt-collection chamber, maximising the capacity of the dirt-collection chamber before the air flow duct becomes obstructed. Also, this arrangement helps to prevent captured dirt and debris falling out of the travelling head, particularly when the travelling head is being carried, by creating a more convoluted path for the dirt and debris to exit the dirt-collection chamber.

Desirably, the air flow duct has a cross-sectional area of around 20 to 30 $cm^2$.

The rotatable brush and impeller may be powered by a single motor, ideally positioned longitudinally in the vacuum cleaner. Preferably, the rotatable brush is driven via a central gear arrangement, and ideally the rotatable brush and the air flow duct are divided into two sections, one each side of the drive shaft.

Desirably, the filter means may be positioned above the dirt-collection chamber. Whilst this increases the height of the travelling head, the advantage of such an arrangement in increased efficiency outweighs the disadvantage in terms of increased height. Specifically, by arranging the filter means above the dirt-collection chamber gravity will cause dirt and debris to fall from the filter, thereby helping to keep the filter cleaner for longer. It is recognised that a filter which becomes clogged with dirt and debris will allow less air to flow, thereby significantly reducing the efficiency of the apparatus. The inventor has created a design of surface cleaning apparatus which can nevertheless meet the 90 mm height criterion despite the location of the filter above the dirt-collection chamber.

Preferably, at least part of the filter means is located above the upper wall. This creates a volume within the dirt-collection chamber which fills particularly efficiently. In preferred embodiments the upper wall projects away from the leading end of the travelling head and towards the trailing end of the travelling head. In such embodiments the flow of air must pass through the air flow duct, around the terminal end of the upper wall and back across the top of the wall. Dirt and debris is pushed to the furthest point of the volume by the continuous air flow, being deposited in the top of the leading end of the dirt-collection chamber, gradually filling backwards from there. This serves to maintain an unobstructed section of filter for longer and to compact the dirt as the chamber fills, so enhancing air flow and dirt capacity. Also, it is easier to detect a full dirt-collection chamber by way of a sensor within the air flow duct.

Desirably, the filter means comprises a primary filter member and a secondary filter member, the primary filter member preceding the secondary filter member in the air flow path, the primary filter member and the secondary filter member being of substantially identical form. Two-part filters are known for vacuum cleaners, which often utilise a primary filter member adapted to capture most of the dirt and debris and a secondary filter member adapted to capture fewer dirt and debris particles. The provision of a primary filter member and a secondary filter member of substantially identical form allows the filter members to be interchangeable.

The filter members of the present invention, in common with the filter members of prior art vacuum cleaners, are designed to be removed and cleaned by the user, whereby to remove some of the captured dirt and debris and increase the subsequent efficiency of the vacuum cleaner. Cleaning a filter by mechanically agitating it creates air-borne dust which is unpleasant, unhealthy and counter-productive to the cleaning operation. A preferable method is to wash the filter under a tap, entraining the dirt and dust in a stream of water. However, most users will typically seek to clean a filter before or during a vacuum cleaning operation, and washing a primary filter in such circumstances is problematic as the filter cannot be dried quickly and dampness causes dust particles to conglomerate. Conglomerated particles restrict air flow considerably more than evenly distributed particles, quickly reducing the performance of the filter. Hence existing washable filters are only suitably cleaned at the end of a vacuum cleaning operation, whereby the filter has sufficient time to dry before the next vacuum cleaning operation.

Interchangeable filters can substantially avoid this problem, however, permitting the user to wash the primary filter member (which will typically capture significantly more dirt and debris than the secondary filter member), and then interchange the filter members so that the secondary filter member thereafter captures most of the dirt and debris whilst the primary filter member is allowed to dry in the passing air flow (the fewer particles encountered by the secondary filter are not enough to cause problems of conglomeration in the time it takes the filter to dry in the air flow of the vacuum cleaner).

Whilst reference is made herein to "impeller", it will be recognised that the invention could utilise a fan or other means to generate the desired air flow. However, the word "impeller" is used to incorporate such alternatives, notwithstanding the expectation that an actual impeller will in fact be used as it is recognised to be the most efficient means to generate the desired air flow in practice.

Desirably, the filter means is removable with the dirt-collection chamber. Providing a filter means which is removable with the dirt-collection chamber allows the filter means to be more reliably sealed to the dirt-collection chamber, reducing the likelihood that air (and entrained dirt) can flow out of the dirt-collection chamber other than through the filter means. Specifically, the filter means can be sealingly mounted upon the dirt-collection chamber whilst these components are separate from the remainder of the travelling head.

Desirably, the filter means has a removable cover. The cover will preferably remain with the filter means when this is removed with the dirt-collection chamber, the cover preventing inadvertent contact with, and potential damage to, the filter member(s) during routine emptying of the dirt-collection chamber. The cover is nevertheless removable in order to permit access to the filter member(s) for cleaning and/or replacement.

In preferred embodiments of the present invention the removable dirt-collection chamber has a lid or cover. The lid is itself removable from the remainder of the dirt-collection chamber, such an arrangement permitting a full dirt-collection chamber to be carried to a waste receptacle or the like with the lid in place. The likelihood of dirt or debris inadvertently falling from the dirt-collection chamber is thereby reduced. Preferably, the filter means is a part of the lid. This permits the filter means to be at least partially cleaned each time the dirt-collection chamber is emptied, for example by tapping the lid upon the waste receptacle so that some or all of the dirt which has adhered to the filter means is dislodged.

Preferably, the dirt-collection chamber has a tunnel for the motor. Accordingly, all (or at least a large part of) the motor can be located within the projected area of the dirt-collection chamber, but is separated from the dirt-collection chamber by the tunnel. Whilst the location of the motor within the projected area of the dirt-collection chamber reduces the volume of the dirt-collection chamber, that location enables the inventor to reduce the overall dimensions of the travelling head, and to provide a particularly attractive and space-efficient vacuum cleaner. Also, since the motor is typically the heaviest component of the travelling head, such a location enables the motor to be close to the physical centre of the travelling head, facilitating ease of manipulation of the surface cleaning apparatus during use.

The use of the rotatable brush to dislodge dirt and debris and to lift the dirt and debris into the air flow, avoids the requirement for the air flow alone to lift the dirt and debris. This enables the air flow to be reduced, thereby increasing the efficiency of the apparatus.

Preferably, the motor is located between the impeller and the rotatable brush. Desirably, the motor has two output shafts, the first output shaft being connected to the impeller, the second output shaft being connected (by way of suitable gearing) to the rotatable brush. The desired air flow will typically determine the rotational speed of the impeller. It is desirable to have a direct drive connection between the motor and the impeller so that the rotational speed of the impeller will determine the rotational speed of the motor. The desired rotational speed of the brush will usually be considerably slower than that of the impeller, and gearing can be provided to obtain the desired rotational rate for the brush. In practical embodiments the impeller will be rotated at between 12,000 and 15,000 rpm, and the motor rotates at the same speed. The gearing for the rotatable brush provides a 4:1 speed reduction whereby the rotatable brush rotates at between 3,000 and 3,750 rpm.

The use of a rotating shaft connecting the motor to the brush is optional, and may in certain embodiments be more space efficient than a belt drive. The present invention can, however, utilise a belt drive if desired, the belt preferably being located at one end of the rotatable brush in common with prior art arrangements. Shaft drive arrangements, and belt drive arrangements, are significantly more energy efficient than the turbine arrangements which are used in some mains powered vacuum cleaners.

BRIEF DESCRIPTION OF THE PREFERRED EMBODIMENTS

The invention will now be described in more detail, by way of example, with reference to the accompanying drawings, in which.

DETAILED DESCRIPTION

Figure 2:
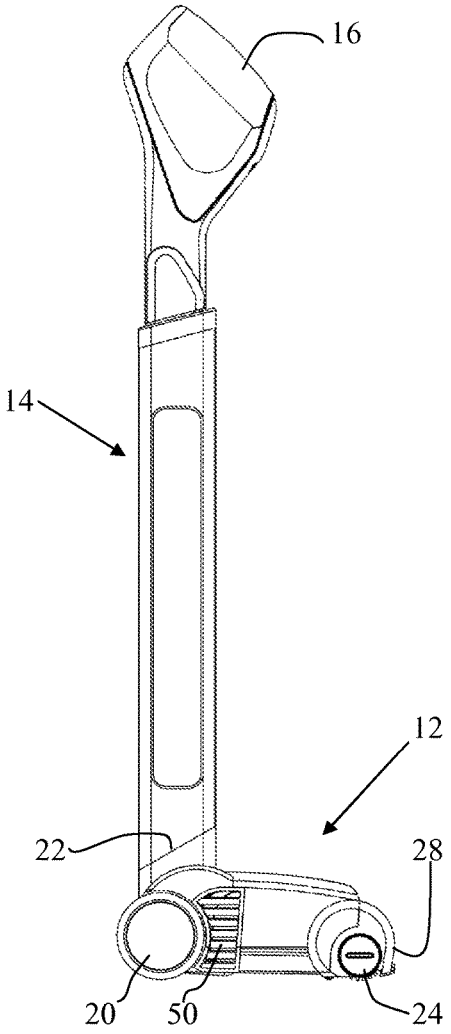
FIG. 2 shows a side view of the vacuum cleaner of FIG. 1.
Figure 1:
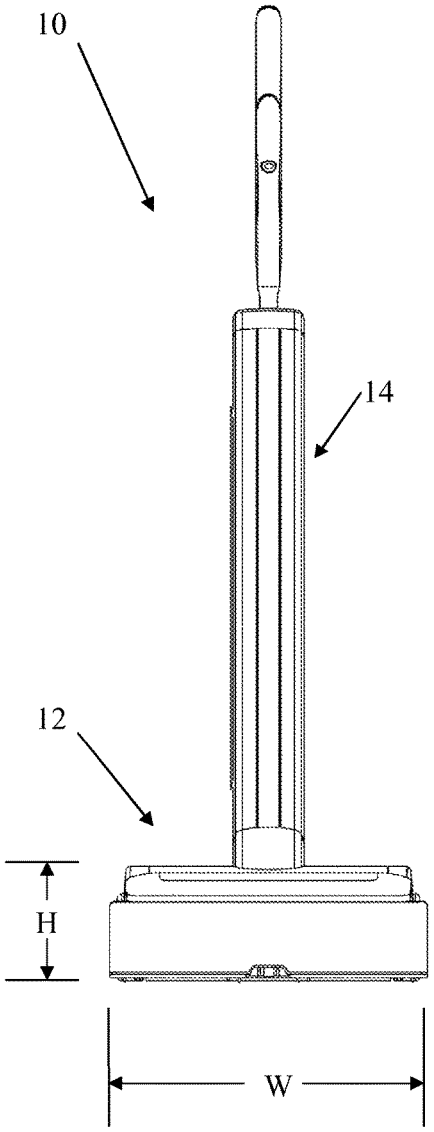
FIG. 1 shows a front view of a vacuum cleaner according to the present invention.

The vacuum cleaner 10 of the present invention is shown in FIGS. 1 and 2. In common with known vacuum cleaners, the vacuum cleaner 10 has a travelling head 12 connected to a handle 14. In use, a user grasps the hand grip 16 of the handle 14 and manipulates the handle whereby to move the travelling head 12 along a desired path.

Also in common with known vacuum cleaners, the handle 14 is pivotable relative to the travelling head, the pivot axis (not shown) being substantially horizontal and transverse to the travelling head, the pivot axis in this embodiment being parallel to, and slightly above and in front of, the axles of the rear wheels 20 (not shown). In addition, the handle has a rotatable swivel joint 22, the rotatable swivel joint being angled at approximately 60° relative to the longitudinal axis of the handle whereby the handle can swivel and the travelling head can be steered by the user, in known fashion.

The travelling head 12 in this embodiment has a height H of approximately 90 mm, and a width W of approximately 292 mm, both of these dimensions meeting the requirements of many of the manufacturers of travelling heads for vacuum cleaners.

Figure 3:
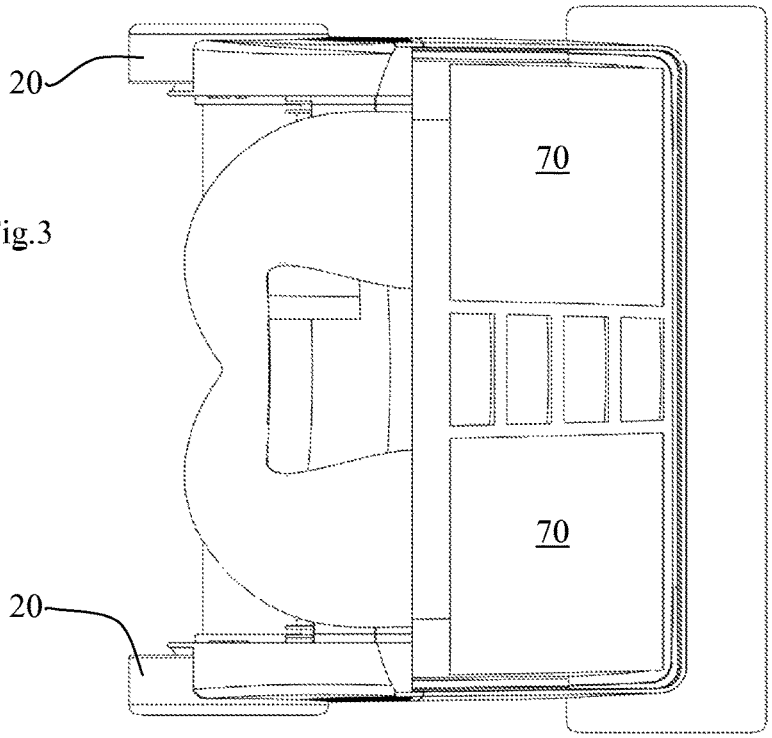
FIG. 3 shows a plan view of the travelling head of the vacuum cleaner (but with the filter cover removed)
Figure 4:
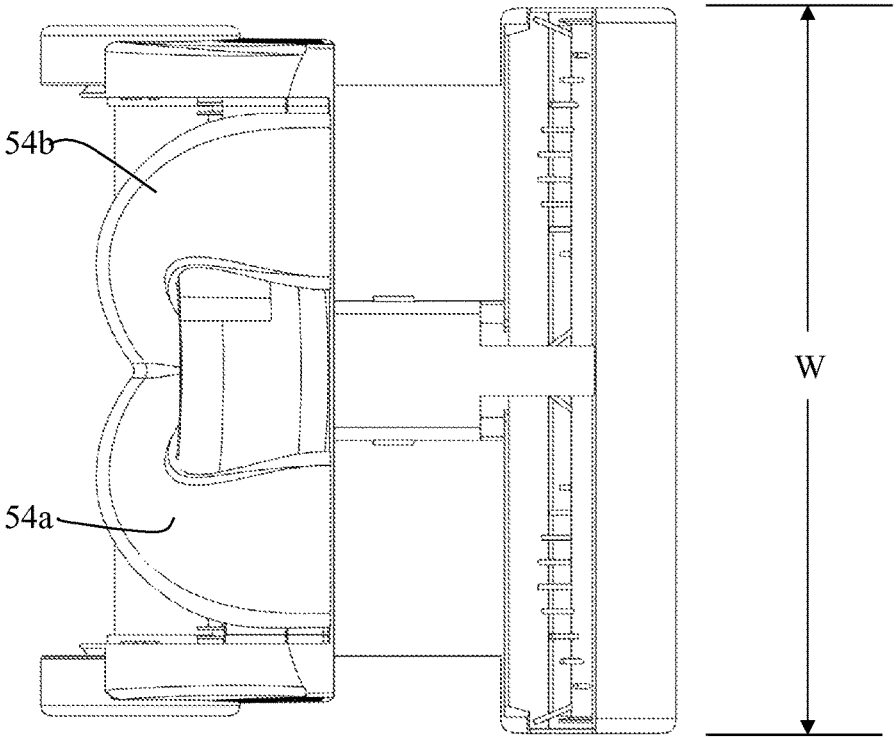
FIG. 4 shows a view as FIG. 3, but with the dirt-collection chamber removed.

The travelling head 12 has a brush chamber 23 in which is housed a rotatable brush 24, the brush 24 having a set of bristles of known form which can project through an opening 26 (FIGS. 5 and 6) at the front of the bottom surface of the travelling head. As seen in FIGS. 3 and 4, the travelling head 12 is substantially rectangular in plan view. This permits the rotatable brush 24 to be located very close to the leading end 28 of the travelling head 12 and still span almost the full width of the travelling head 12 (as shown most clearly in FIG. 4 the length of the rotatable brush 24 is only slightly less than the width W of the travelling head 12).

Figure 5:
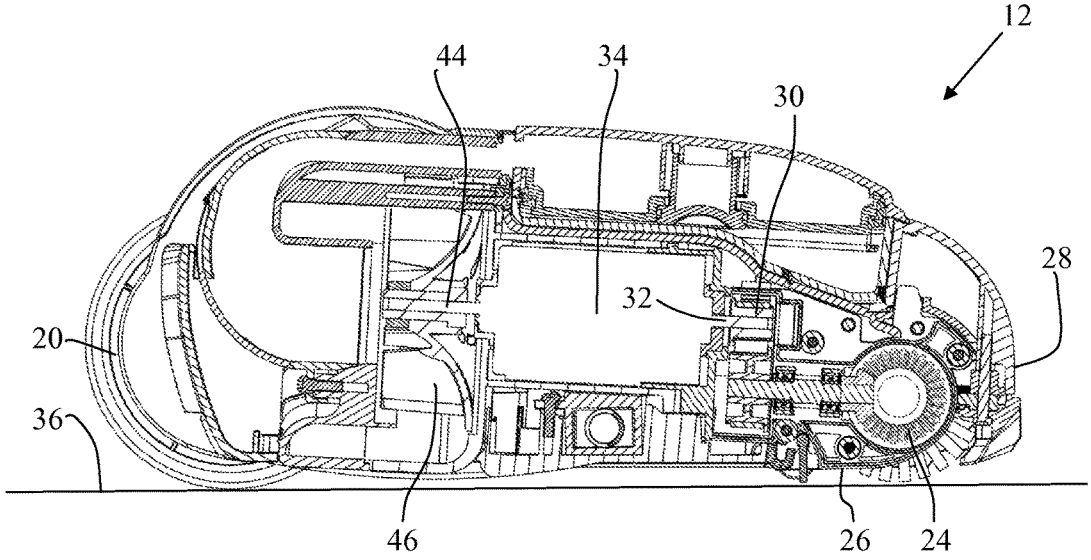
FIG. 5 shows a longitudinal sectional view along the approximate centre line of the vacuum cleaner.
Figure 8:
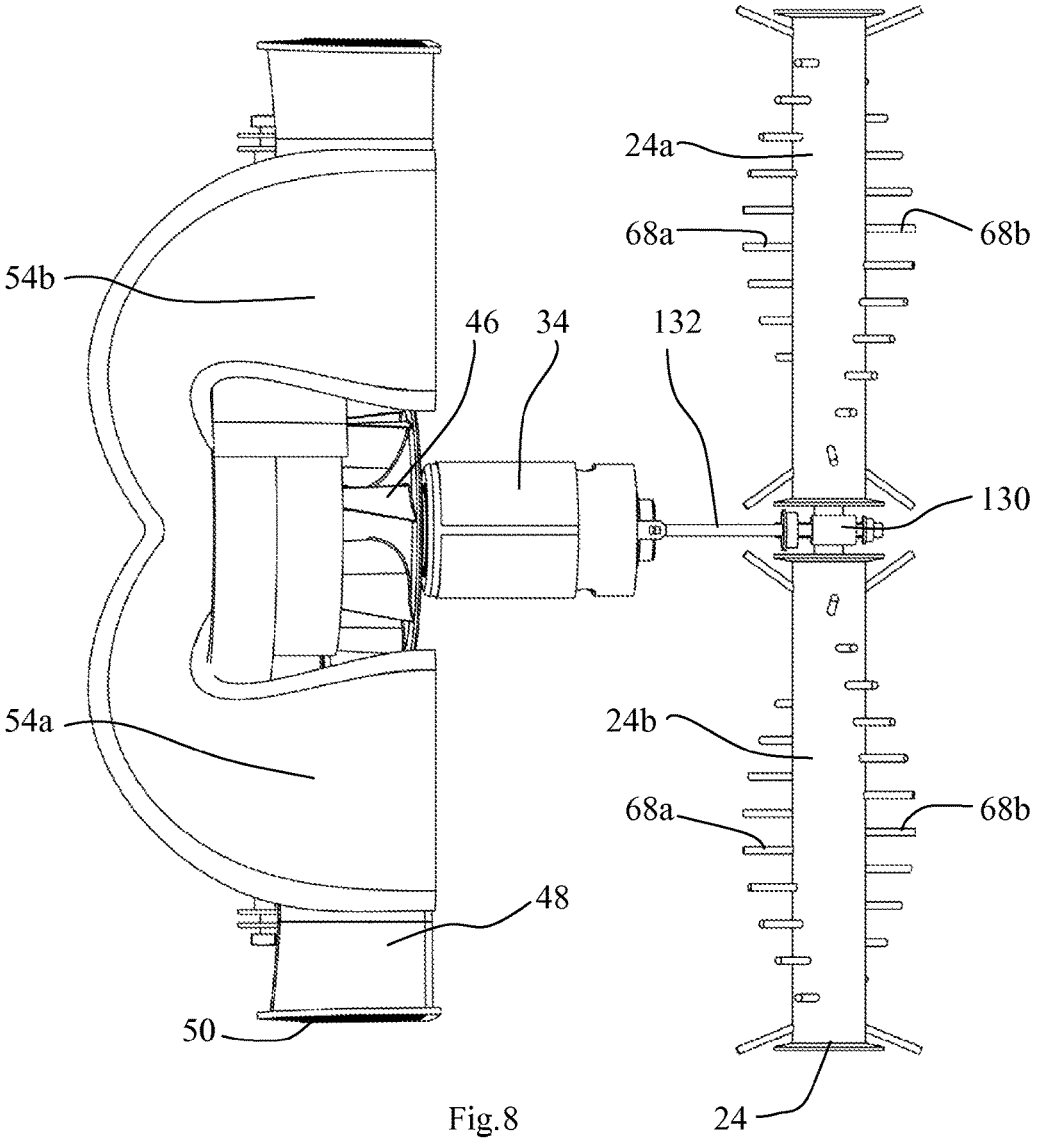
FIG. 8 shows the rotatable brush, motor and impeller of the vacuum cleaner, and part of the air flow passageways of the alternative embodiment.
Figure 11:
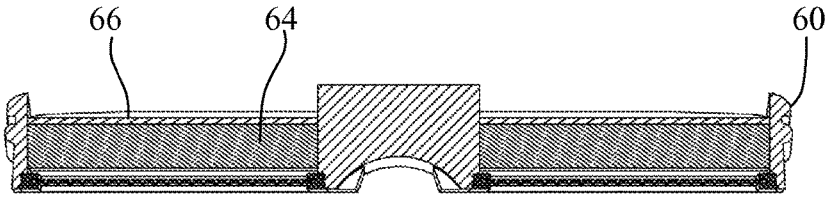
FIG. 11 shows a transverse sectional view through the filter means.

As seen in the different embodiments of FIGS. 5 and 8, the rotatable brush 24 is connected by way of respective gearing 30, 130 to a secondary drive shaft 32, 132 of the electric motor 34, whereby the motor 34 can drive the rotatable brush 24 to rotate. It will be understood that the rotatable brush 24 is driven to rotate clockwise as viewed in FIGS. 5 and 6, so that dirt and debris which are dislodged from the surface 36 can be driven up the ramp 38, through the air flow duct 40 and into the dirt-collection chamber 42 (see FIG. 6).

The primary drive shaft 44 of the motor 34 is connected to an impeller 46. When the impeller 46 rotates it drives air from adjacent its centre towards the ends of its blades, the air passing along channel 48 (FIGS. 6 and 8) and out through vents 50 (FIGS. 2 and 8). Rotation of the impeller 46 thereby generates an air flow through the travelling head 12, which air flow is represented by the arrows in FIG. 6. The air enters the brush chamber 23 of the travelling head 12 through the opening 26. It will be understood that the majority of the air which enters the opening passes through the gap G between the bottom of the leading edge 28 and the surface 36, although some air passes through the gap to the sides and rear of the opening 26, and some may pass through the material of the surface 36 if that is carpeting for example. The air passes along the air flow duct 40 and into the dirt-collection chamber 42, upwards through the filter means 52, along the air passageway 54, past impeller 46, along the passageway 48 and out of the travelling head 12 through the vents 50.

It will be understood that, in common with carpet sweepers, some dirt and debris can be collected into the travelling head 12 by the rotating brush 24 alone, i.e. dirt and debris can be mechanically dislodged from the surface 36 by the rotating brush 24 and driven up the ramp 38 and into the dirt-collection chamber 42. The ramp 38 and the air flow duct 40 are shaped so that dirt and debris which is propelled by the rotatable brush 24 and which impacts the ramp and/or the air flow duct will be guided towards the dirt-collection chamber 42. Thus, the short length of the air flow duct 40, as well as its large cross-sectional area, contribute to the cleaning efficiency by causing much or all of the dirt and debris which is dislodged by the rotatable brush to be driven into the dirt-collection chamber 42, even without the assistance of the air flow.

In general, carpet sweepers are engineered with clearance around the rotatable brush and open areas around the dirt-collection chamber so as to reduce turbulence and air flow within the travelling head, which impairs their performance particularly on hard floors where lighter dust and debris is blown along by even small amounts of turbulence rather than being collected. Air flow and turbulence also impair sweeper performance as fine dust dislodged by the rotating brush becomes airborne and soils the outer surfaces of the appliance, counteracting the cleaning operation and reducing air quality in the room. Introducing an air flow duct to sweepers would therefore be counter-productive as the duct would quickly become blocked and serve only to reduce the useful capacity of the dirt-collection chamber. Therefore, despite its advantages it is not intended that the present invention be practised with carpet sweepers, and the provision of the air flow duct 40 to control the air currents within the travelling head (as well as the filter means 52 and the impeller 46), distinguish the present invention from carpet sweepers.

The cross-sectional area of the air flow duct 40 is large compared to the area through which air enters the brush chamber 23 (i.e. the gap G at the front of the travelling head and the corresponding gaps around the travelling head), and is preferably larger than the area through which air enters.

The cross-sectional area of the air flow duct 40 is also relatively large compared to the cross-sectional areas of the brush chamber 23 and of the dirt-collection chamber 42, i.e. whilst it is smaller than the cross-sectional areas of the brush chamber and the dirt-collection chamber it is a larger proportion of those areas than in prior art vacuum cleaners, whereby to minimise the restriction of the air flow along the air flow duct.

Figure 6:
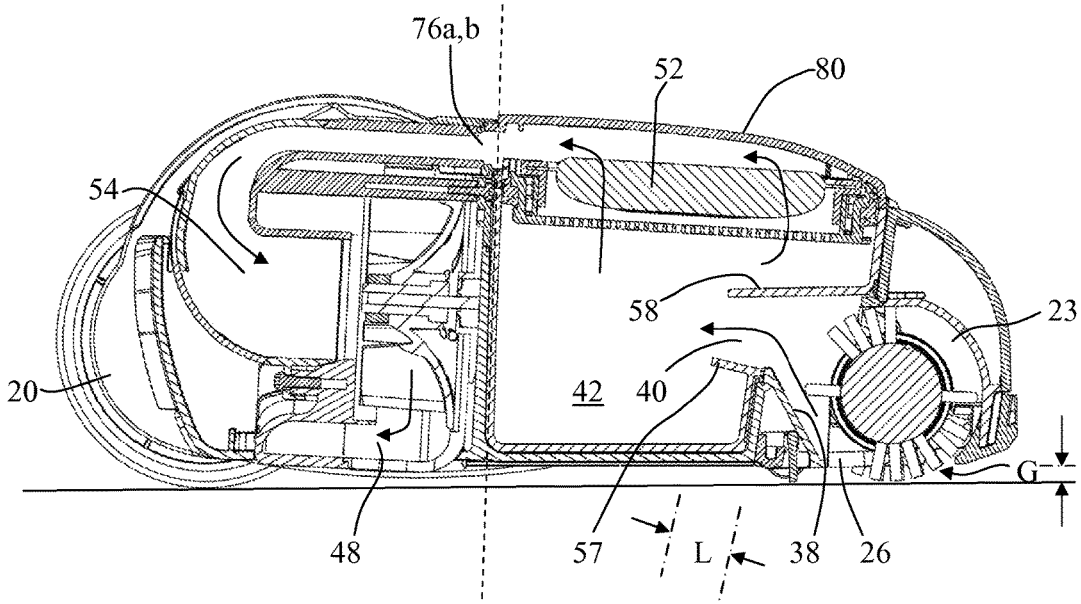
FIG. 6 shows a longitudinal sectional view similar to that of FIG. 5, with the portion to the left of the dashed line being along the approximate centre line and the portion to the right of the dashed line being offset from the centre line.

Importantly, as seen in FIG. 6, the filter means 52 is located above the dirt-collection chamber 42. The advantage of this is that dirt and debris which is entrained in the air flow and which engages the underside of the filter means will fall off, either during operation of the apparatus, or when the air flow is stopped.

The air flow duct 40 spans substantially the full width of the dirt-collection chamber 42, and substantially the full width of the rotatable brush 24. The bottom of the air flow duct 40 is defined by the top of the ramp 38 and the lower wall 57, and the top of the air flow duct is defined by upper wall 58. The space between the lower wall 57 and the upper wall 58 is as large as possible within the constraints of the dimensions of the travelling head, whereby to maximise the cross-sectional area of the air flow duct 40. In addition, the air flow duct 40 is as free as possible of restrictions and constrictions. The air flow duct 40 is also relatively short, having a length L which is preferably less than the diameter of the rotatable brush 24, and ideally less than half of the diameter of the rotatable brush.

It will be understood that with a large proportion of the air flow passing through the gap G, the air flow past the rotating brush 24 will be largely tangential relative to the brush. As shown in FIG. 6, the air flow duct 40 is substantially tangential to the rotatable brush, and the substantially full-width duct 40 restricts and deviates the tangential air flow as little as possible, so that dirt and debris can be carried efficiently through the air flow duct 40 and into dirt-collection chamber 42. In particular, much of the rotatable brush 24 and the dirt-collection chamber 42 are in direct line of sight of each other substantially across their full width, which is in direct contrast to the restricted and convoluted air flow ducts used in most vacuum cleaners.

Figure 7:
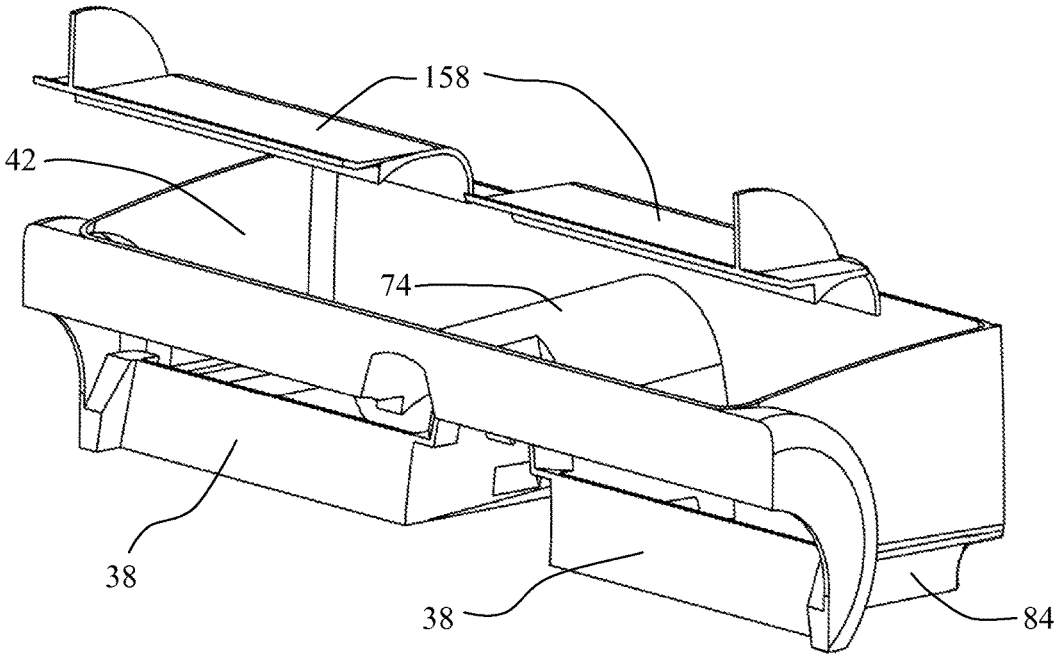
FIG. 7 shows an exploded view of an alternative embodiment of dirt-collection chamber.

In the preferred embodiment of FIG. 6 the upper wall 58 is substantially linear, but in the less preferred alternative embodiment of FIG. 7 the upper wall 158 is curved downwardly (the downward curvature of the wall 158 does not reduce the minimum cross-sectional area of the air flow duct in that embodiment). In embodiments such as that of FIGS. 7 and 13 in which the wall 158 curves downwardly the terminal end of the wall is ideally at a height close to that of the top of the ramp 38.

It will be observed in FIG. 6 that both of the upper wall 58 and the lower wall 57 project into the dirt-collection chamber. Whilst the projecting walls assist in smoothing the air flow into the dirt-collection chamber 42, they reduce the likelihood of dirt and debris passing out of the dirt-collection chamber back along the air flow duct 40. Thus, dirt and debris which has been deposited in the dirt-collection chamber 42 will be less likely to fall out of the travelling head, particularly when the travelling head is being carried, i.e. the projecting walls 57, 58 create a more convoluted path along which the dirt and debris must pass and therefore reduce the likelihood of the dirt and debris falling out.

In the preferred embodiment shown in FIGS. 5 and 6, at least part of the filter means 52 lies directly above the upper wall 58, creating a volume of the dirt-collection chamber 40 above the upper wall 58. Tests conducted by the inventor have shown that the convoluted path which the air must take once it is within the dirt-collection chamber, and in particular the path taken to reach the leading end of the filter means 52, is advantageous in trapping lighter particles of dirt and debris (such as hair and fluff) in the volume above the upper wall 58. Specifically, it has been observed that heavier particles of dirt or debris do not tend to take such a convoluted path, and instead become deposited adjacent the trailing bottom corner of the dirt-collection chamber 42 (the bottom left corner as drawn in FIGS. 5 and 6). Lighter particles of dirt and debris are however transported around the terminal end of the upper wall 58, and pass over the upper wall 58 to become trapped by the filter means 52 within the volume above the upper wall 58. As more dirt and debris is carried into this volume the dirt and debris becomes somewhat compacted therein. As the dirt-collection chamber 42 becomes full, the filter means 52 becomes gradually blocked by dirt and debris from the leading end towards the trailing end, this gradual blocking of the filter means 52 maintaining an acceptable air flow substantially until the dirt-collection chamber 42 is full.

The relatively low air speed through the dirt-collection chamber 42, and also through the full-width filter means 52, reduces the compaction of fluff and hair upon the filter means 52, which compaction is understood to reduce the air flow in vacuum cleaners utilising high air speeds. Since air can continue to flow through the captured fluff and hair the cleaning efficiency of the vacuum cleaner can be substantially maintained until the dirt-collection chamber 42 is full.

Though not shown in the figures, in preferred embodiments of the invention an infra-red source and sensor are located within the air flow duct 40 so as to indicate when the dirt-collection chamber 42 requires emptying.

It will be seen that the minimum height of the air flow duct 40, and therefore the minimum cross-sectional area of the air flow duct, is defined by the separation between the lower wall 57 and the upper wall 58 at the trailing end of the air flow duct 40. This (vertical) dimension can be increased if desired by reducing the upward angling of the lower wall 57, or by raising the upper wall 58. There is, however, a compromise between the angle of the lower wall 57 and the retention of captured dirt and debris, particularly when the travelling head is being carried. There is also a compromise between the desire to increase the cross-sectional area of the air flow duct 40 (and thereby maximise the air flow along the air flow duct) and maintaining an effective volume between the wall 58 and the filter means 52, whilst still restricting the height H of the travelling head 12 to 90 mm.

FIG. 8 shows more detail of the rotatable brush 24 which is used with both of the embodiments shown. The rotatable brush 24 is driven by the gearing 130 which is located substantially centrally along the length of the rotatable brush, the gearing 130 acting to separate the rotatable brush 24 into two (substantially identical) parts 24*a* and 24*b*. Two rows of helically-arranged bristles 68*a* and 68*b* are arranged on each of the parts 24*a* and 24*b*, the rows being substantially diametrically opposed around the hub of the rotatable brush. In preferred embodiments it is arranged that the bristles 68*a* are softer and finer than the bristles 68*b*, whereby the rotatable brush 24 is effective upon hard floors (where softer bristles are more suitable) and also upon carpets (where stiffer bristles are more suitable).

As seen in FIGS. 9-12, the filter means 52 comprises a substantially rigid housing 60 which is adapted to locate and support the filter members. Specifically, in the direction of the (upward) air flow through the filter means 52, the filter means comprises a first filter member 62, a second filter member 64 and a third filter member 66.

In this embodiment the first filter member 62 is a metal screen supported by a rectangular frame 70. The function of the metal screen 62 is to capture large particles of dirt and debris, and to prevent dirt and debris sticking to the second filter member 64. The second filter member 64 in this embodiment is an electrostatically charged wadding filter which captures most of the dirt particles which are able to pass through the metal screen 62. The third filter member 66 is for capturing the finer particles of dust which are able to pass through the second filter member 64. The third filter member 66 also helps to protect the second filter member 64 and maintain it in position.

It will be understood that in an alternative embodiment the filter means could comprise a metal (or plastic) screen and second and third filter members which are identical in form, and are therefore interchangeable.

It will be understood that the filter means 52, and in particular the first filter member 62, is substantially horizontal in use (i.e. when the travelling head is lying upon a substantially horizontal surface 36). Thus, gravity is able to provide the maximum assistance in keeping the filter means free of dirt and debris which might become suspended upon the underside of the filter means 52 by the air flow.

An alternative filter design utilises a pleated filter having a PTFE coating. The pleating increases the surface area of the filter, and the PTFE coating reduces the likelihood of dirt and dust sticking to the filter.

Figure 9:
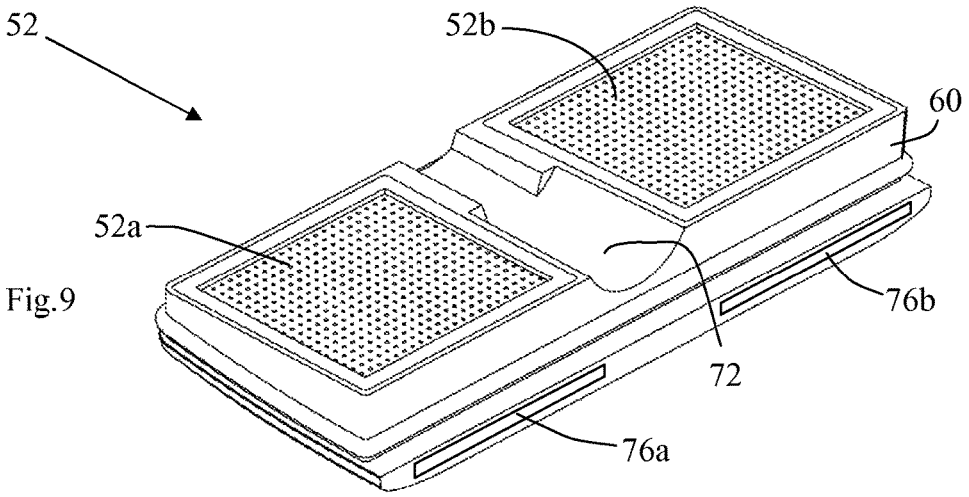
FIG. 9 shows a perspective view from below of the filter means of the vacuum cleaner apparatus.
Figure 10:
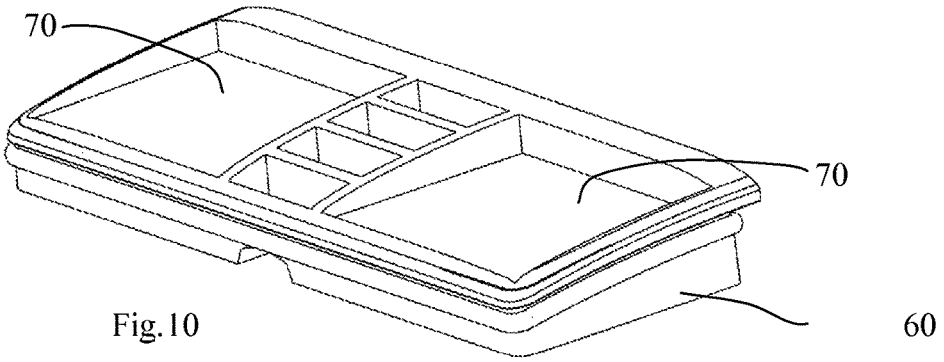
FIG. 10 shows a perspective view from above of the filter means.
Figure 12:
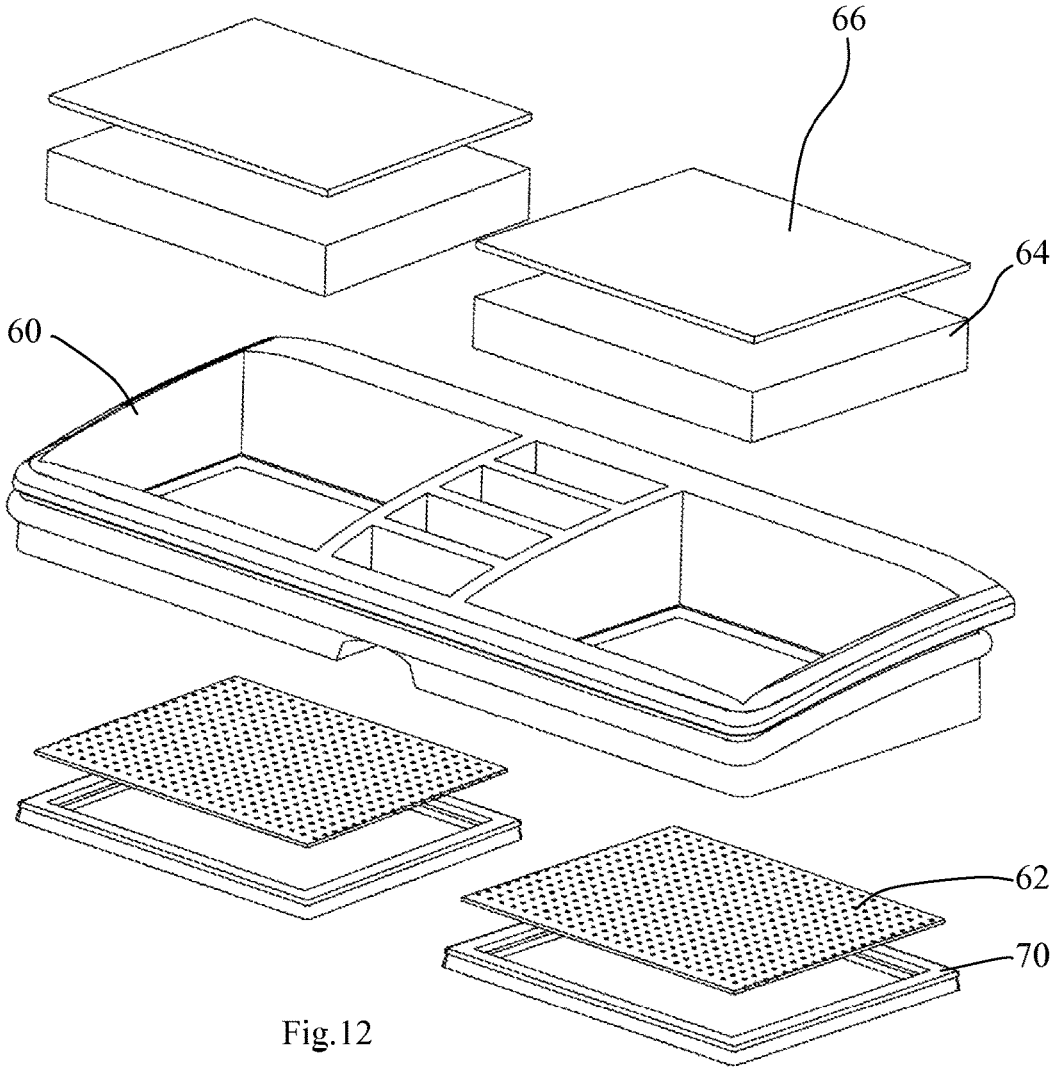
FIG. 12 shows an exploded view of the filter means.

It will be seen in FIG. 9 that the underside of the housing 60 has a depression 72, the depression 72 accommodating the top of the motor 34. Thus, in this embodiment the motor 34 lies within the projected area of the dirt-collection chamber 42 (when viewed from the side as in FIGS. 5 and 6), the dirt-collection chamber having a tunnel 74 (FIG. 7) for the motor 34, which tunnel effectively separates the dirt-collection chamber 42 into two separate halves 42*a* and 42*b* (and similarly separates the air flow duct 40 into two halves). The filter means 52 is therefore also similarly split into two separate halves 52*a* and 52*b*, each half of the filter means having its own filter members 62, 64 and 66.

Each half 52*a*, 52*b* of the filter means 52 can communicate with a respective part 54*a*, 54*b* of the air passageway 54 by way of a respective opening 76*a*, 76*b*. The air flows through each of the air passageways 54*a,b* before combining into the single air passageway 54 to the rear of the impeller 46.

The arrangement of the two air passageways 54*a,b* at the top and rear of the travelling head 12 presents a visually distinctive, and visually pleasing, arrangement. In addition, the space between the air passageways 54*a,b*, and specifically the space above the location where the air passageways 54*a* and 54*b* combine into the single air passageway 54, is a suitable position for mounting the handle 14 and its pivot axis.

It will be understood that the location of the filter above the dirt-collection chamber is preferable in terms of efficiency, but results in an increase in the height of the travelling head. If it was desired to reduce the height of the travelling head the filter could be positioned in the rear wall of the dirt-collection chamber, in known fashion.

Figure 13:
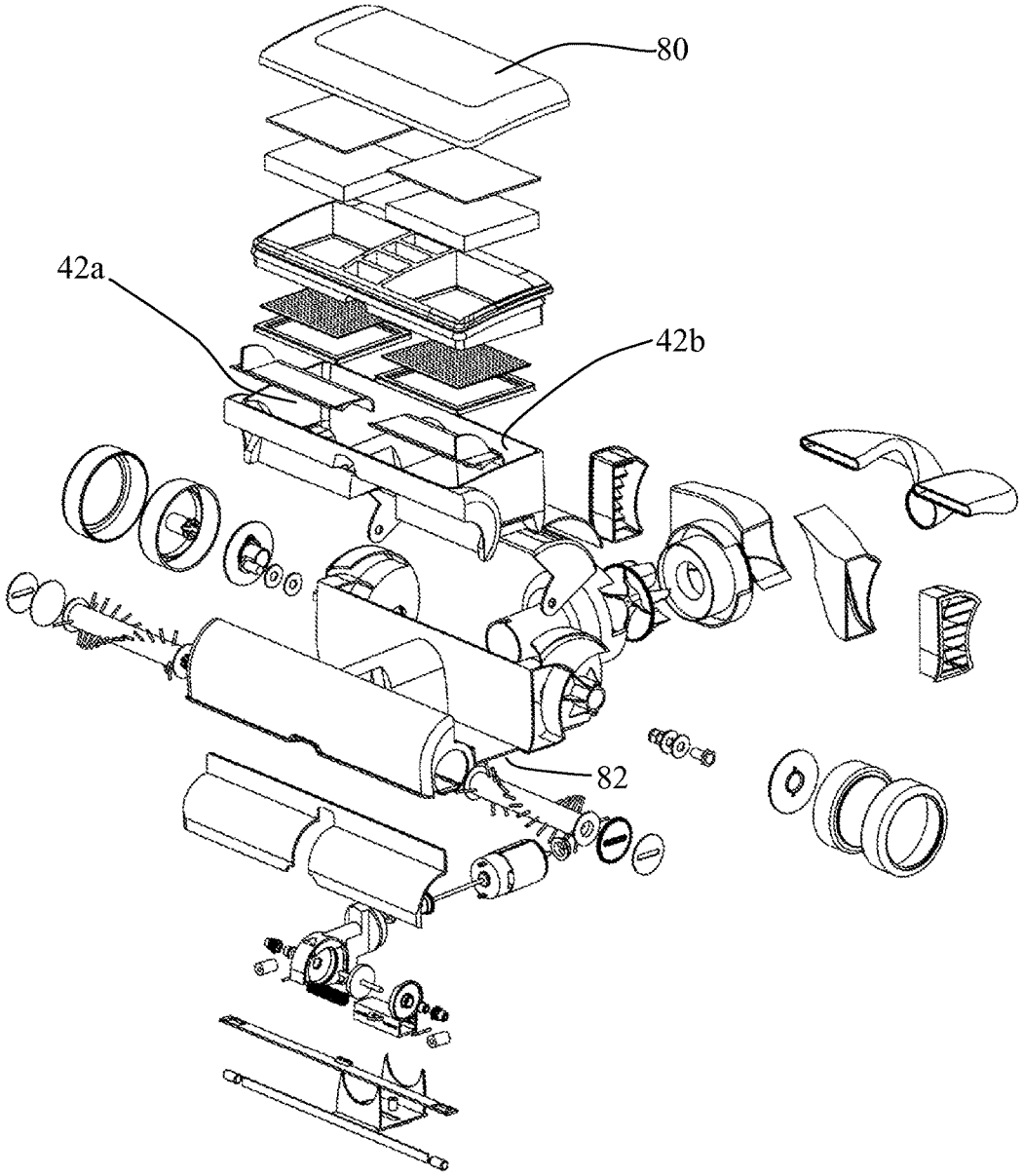
FIG. 13 shows an exploded view of most of the components of the alternative embodiment of travelling head.

Though not shown in FIGS. 9-12, the filter means 52 is closed by a cover 80 (see FIGS. 6 and 13). The cover 80 is removable to permit removal of the filter members when required, but will normally remain in place so as to protect the filter members from inadvertent damage.

As shown by FIG. 3, the cover 80 can be removed to expose the filter members 70 whilst the filter means 52 (and the dirt-collection chamber 42) remain with the travelling head. That is not expected to be a normal situation, however, as it is expected that the cover 80 would be removed only when the filter members are to be periodically replaced or fully cleaned. Removal of the cover 80 is expected to take place only after the dirt-collection chamber 42, filter means 52 and cover 80 have together been removed from the remainder of the travelling head, and the filter means 52 and cover 80 have subsequently been removed from the dirt-collection chamber 42.

As seen in FIG. 4, the dirt-collection chamber 42 (together with the filter means 52 and cover 80—which together form a lid for the dirt-collection chamber) is removable from the travelling head 12. Specifically, the user may grasp one side of the dirt-collection chamber 42 and lift it from the remainder of the travelling head 12. It is desirable that this is a one-handed operation for most users, and the chassis of the travelling head 12 has a recess 82 (see FIG. 13) formed thereinto, which recess permits a user's fingers to enter into a depression 84 (FIG. 7) in the underside of the dirt-collection chamber 42. The user's thumb can be placed onto the lid 80 whereby the dirt-collection chamber 42, filter means 52 and cover 80 can be removed together and taken to a waste bin or the like, whereupon the lid comprising the filter means 52 and the cover 80 can be removed from the dirt-collection chamber 42 so that the chamber 42 can be emptied. Once the lid has been removed, the user may partially clean the filter members 62, 64 by tapping the lid upon a waste receptacle for example, whereby some or all of the dirt which has adhered to the filter members 62 and 64 may be dislodged.

It will be observed that the upper wall 58 and the lower wall 57 are both connected to (and therefore removable with) the dirt-collection chamber 42. This helps to ensure that any dirt and debris which lies within the air flow duct 40 is removed with the dirt-collection chamber and can be disposed of. The removal (and subsequent emptying) of part or all of the air flow duct with the dirt-collection chamber will reduce the likelihood of the air flow duct becoming blocked.

Though not shown in these drawings, the underside of the filter housing 60 carries a sealing strip which serves to seal the filter means 52 onto the dirt-collection chamber 42 and prevent the passage of unwanted air between these components in use. The filter means 52 can be clipped or otherwise temporarily secured to the dirt-collection chamber 42, and this temporary securement may also compress the sealing strip.

It will be understood that the drive shaft 32 occupies a significantly smaller volume of the travelling head 12 than does the gearing and belt drive which is commonly used on the travelling heads of surface cleaning apparatus. Also, the location of the motor 34 within the projected area of the dirt-collection chamber 42 enables the manufacture of a very space-efficient travelling head 12 without a significant reduction in the volume of the dirt-collection chamber 42.

However, the central motor 34 does restrict slightly the size of the dirt-collection chamber 42. Thus, whilst the dirt-collection chamber 42 spans substantially the full width of the travelling head 12, it does not have quite the same lateral extent as the rotatable brush 24 and the air flow duct 40, because of the presence of the motor tunnel 74. If it was desired to increase the lateral extent of the dirt-collection chamber the motor could be repositioned behind the dirt-collection chamber, and a drive belt for example could be used to communicate drive to one end of the rotatable brush, in known fashion.

Figure 14:
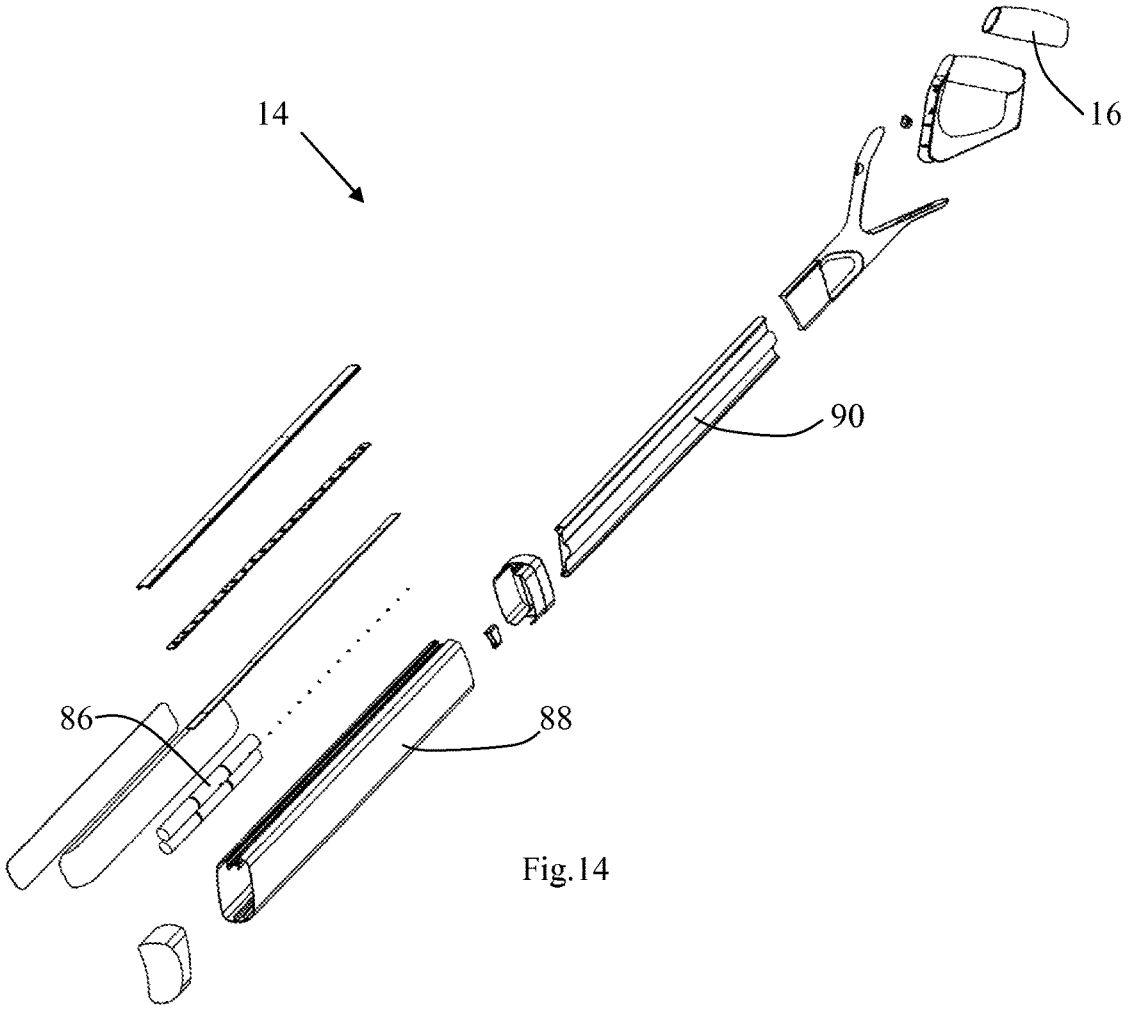
FIG. 14 shows an exploded view of the handle.

FIG. 14 shows the structural detail of this embodiment of handle 14. The handle 14 contains the rechargeable battery pack 86 within a tube 88. The hand grip 16 is connected to a shaft 90 which slides within the tube 88, whereby the length of the handle can be reduced for storage, and lengthened for use. If desired, the shaft 90 and tube 88 can provide a number of detent positions permitting a number of different handle lengths. The multiple handle heights can therefore accommodate varying heights of user as well as facilitating use in confined spaces/small rooms.

With the exception of the battery pack 86, all of the operating components of the surface cleaning apparatus are located in the travelling head 12.

Figure 15:
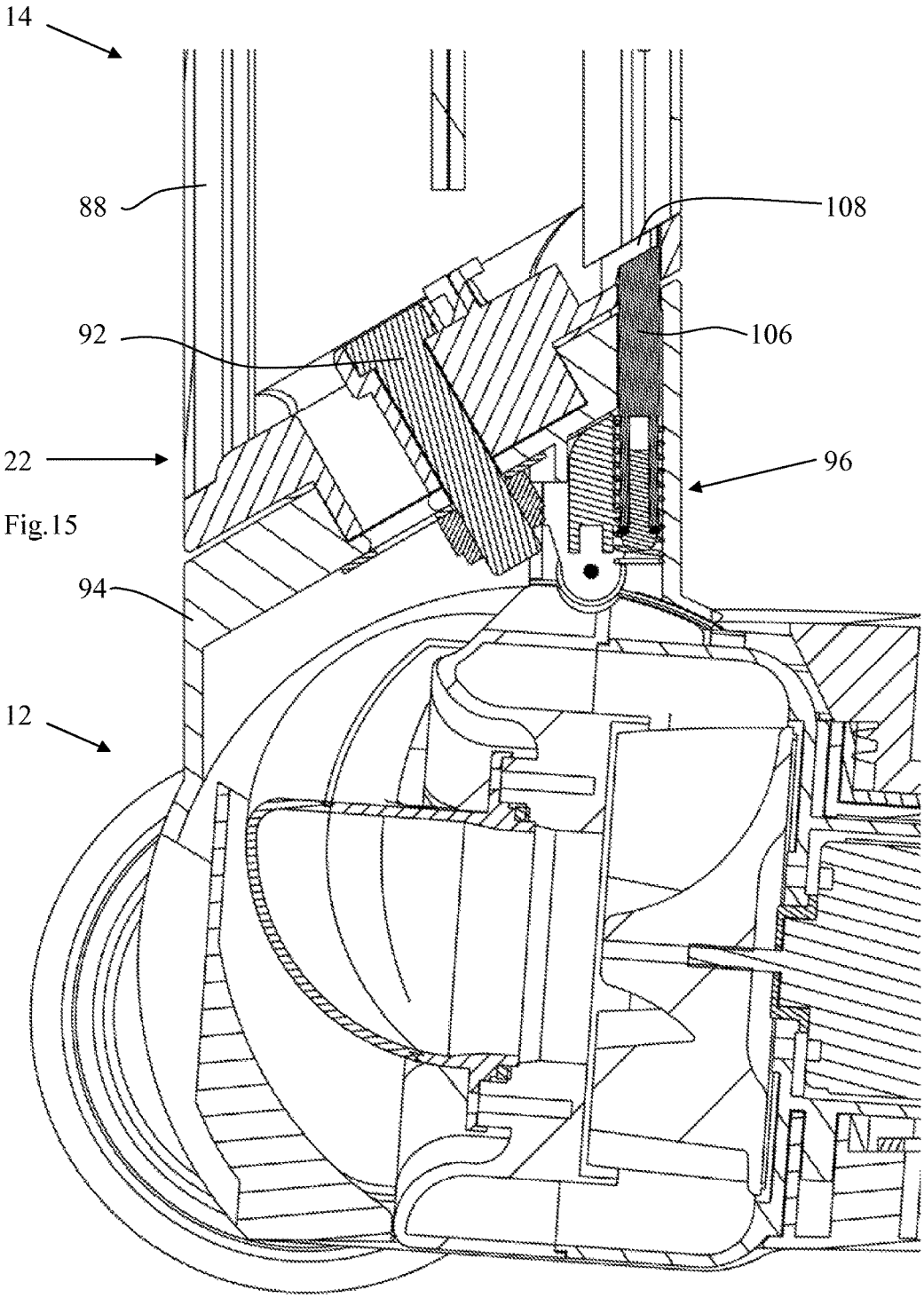
FIG. 15 shows a sectional view through the centre of part of the travelling head and handle.
Figure 16:
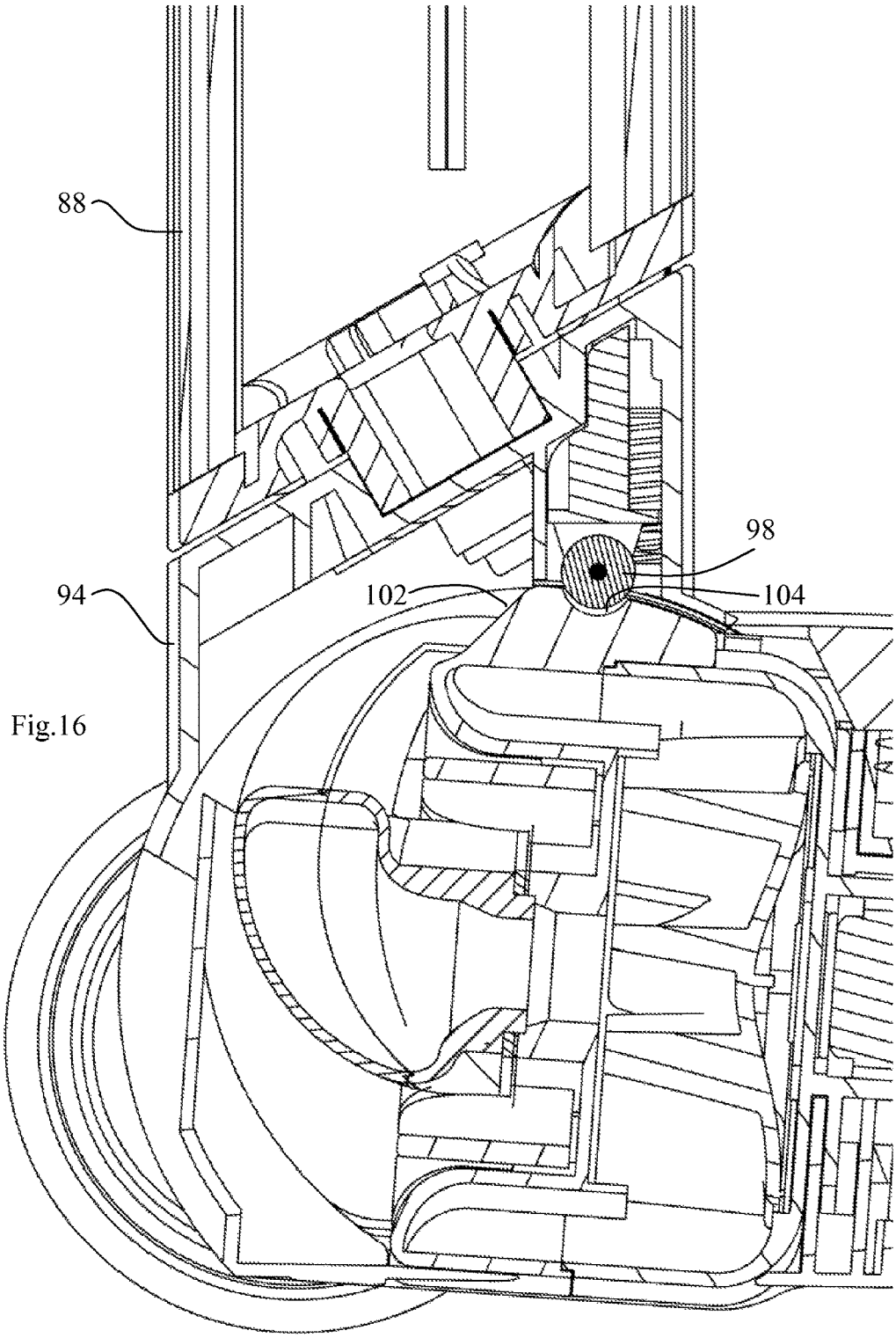
FIG. 16 shows a sectional view similar to FIG. 15, but slightly offset from the centreline.

FIGS. 15 and 16 show the connection between the travelling head 12 and the handle 14 in more detail, and specifically show the parking facility for the handle 14. The rotatable joint 22 includes a pivot bolt 92 which permits the tube 88 to swivel relative to the connection portion 94. The connection portion 94, and thereby the whole of the handle 14, can pivot about the substantially horizontal pivot axis (not shown) as previously described. When the handle 14 is to be parked for storage, it is desirable that the tube 88 be substantially vertical. This requires both the connection portion 94 to be held in a substantially vertical orientation, and also the rotatable swivel joint 22 be held with the tube 88 substantially aligned with the connection portion 94, as shown in FIGS. 15 and 16.

The present invention achieves both of these requirements by providing a movable member 96 which includes roller 98 (FIG. 16) which can move across a surface 102 of the travelling head 12. The surface 102 includes a detent 104, which in the parked position of FIGS. 15 and 16 accommodates the roller 98. The movable member 96 is resiliently biased (downwardly as drawn in FIGS. 15 and 16) whereby to retain the roller 98 within the detent 104 and retain the connection portion 94 in a substantially vertical orientation.

The movable member 96 includes a projection 106 which can project beyond the connection portion 94, and specifically into a recess 108 in the tube 88. It will be understood that when the projection 106 is engaged in the recess 108, pivoting movement about the pivot bolt 92 is prevented, whereby the handle 14 is maintained in its substantially vertically aligned position.

When it is desired to use the vacuum cleaner, the handle 14 is pivoted to the left as drawn in FIGS. 15 and 16, which drives the roller 98 out of the detent 104. The roller can move down the surface 102 and it is arranged that the surface 102 has a sufficient slope to allow the projection 106 to move out of the recess 108, whereupon the tube 88 can be swivelled relative to the connection portion 94.

In the present embodiment the roller 98 is offset from the longitudinal axis of the projection 106, to save space, and in this embodiment there are two rollers, one to either side of the axis of the projection 106. It will be understood that in other embodiments the roller could be placed along the axis of the projection if desired.

Also, in the present invention the tube 88 and connection portion 94 have cooperating detent means whereby the tube 88 can be temporarily secured in alignment with the connection portion 94 prior to the projection 106 entering the recess 108. The recess and projection can additionally (or alternatively) have cooperating lead-in surfaces whereby insertion of the projection into the recess serves to align the tube 88 with the connection portion 94.

It will be observed that the embodiment of FIGS. 7 and 13 differs from that of FIGS. 5 and 6 in the shape of the upper wall of the air flow duct. The embodiments are otherwise similar and their respective features can therefore be interchanged if desired. It will also be observed that the embodiment of FIG. 5 differs from that of FIG. 8 in using a different gear arrangement between the motor and the rotatable brush. The embodiments are also otherwise similar and their respective features can therefore be interchanged if desired.

The invention claimed is:

1. A vacuum cleaner having a travelling head connected to a handle, the travelling head being adapted to be moved across a surface to be cleaned by way of the handle, the travelling head having a leading end and a trailing end, the travelling head also having:

a rotatable brush, the rotatable brush being located in a brush chamber at the leading end of the travelling head, the brush chamber having an opening through which a part of the rotatable brush projects, the opening and the rotatable brush spanning substantially the full width of the travelling head;

an impeller;

a motor for driving the rotatable brush and the impeller;

a removable dirt-collection chamber spanning substantially the full width of the travelling head;

a filter means located between the dirt-collection chamber and the impeller, the filter means also spanning substantially the full width of the travelling head;

and an air flow duct connecting the brush chamber to the dirt-collection chamber, the leading end of the air flow duct being substantially tangential to the rotatable brush, the air flow duct spanning substantially the full width of the travelling head throughout the whole length of the air flow duct.

2. A vacuum cleaner according to claim 1 in which the top of the air flow duct is defined by an upper wall which projects into the dirt-collection chamber.

3. A vacuum cleaner according to claim 1 having a ramp adjacent to the rotatable brush, the top of the ramp defining a part of the bottom of the air flow duct.

4. A vacuum cleaner according to claim 2 in which the filter means is located above the dirt-collection chamber.

5. A vacuum cleaner according to claim 4 in which a part of the filter means is located above the upper wall.

6. A vacuum cleaner according to claim 1 in which the removable dirt-collection chamber has a removable lid, the filter means being located within the removable lid.

7. A vacuum cleaner according to claim 1 in which the filter means comprises a primary filter member and a secondary filter member, the primary filter member preceding the secondary filter member in the air flow path, the primary filter member and the secondary filter member being washable and interchangeable.

8. A vacuum cleaner according to claim 1 in which the dirt-collection chamber has a tunnel within which at least a part of the motor is located.

9. A vacuum cleaner according to claim 8 in which the tunnel separates the dirt-collection chamber into two separate parts.

10. A vacuum cleaner according to claim 9 in which each of the separate parts has its own filter means.

11. A vacuum cleaner according to claim 1 in which a single motor drives the rotatable brush and the impeller, and in which the motor is located between the impeller and the rotatable brush.

12. A vacuum cleaner according to claim 11 in which the motor has two output shafts, the first output shaft being connected to the impeller, the second output shaft being connected to the rotatable brush.

13. A vacuum cleaner according to claim 1 in which the rotatable brush has a first set of bristles and a second set of bristles, the second set of bristles being stiffer than the first set of bristles.

14. A vacuum cleaner according to claim 1, the handle having a longitudinal axis, the handle being pivotable about a substantially horizontal pivot axis, the longitudinal axis of the handle being substantially perpendicular to the pivot axis, the handle also being swivellable about a swivel axis, the swivel axis being at an acute angle to the longitudinal axis, the handle including locking means which can act to prevent swivelling of the handle.

15. A vacuum cleaner according to claim 14 in which the locking means acts to prevent swivelling of the handle when the handle is in a predetermined pivoted position.

16. A vacuum cleaner according to claim 14 in which the handle carries a projection which can move into a recess, swivelling of the handle being prevented when the projection is located within the recess, and in which the handle has a member which can be located within a detent whereby to define a storage pivoted position for the handle, the member being connected to the projection, and in which the projection is located within the recess when the member is located in the detent.

17. A vacuum cleaner according to claim 1 which is substantially rectangular in plan view.

18. A vacuum cleaner according to claim 1 in which a substantial part of the air flow duct is removable with the dirt-collection chamber.

19. A vacuum cleaner according to claim 1 having a lower wall which defines part of the bottom of the air flow duct, an upper wall which defines a top of the air flow duct, the lower wall projecting into the dirt-collection chamber.

20. A vacuum cleaner according to claim 19 in which the upper wall and the lower wall are removable with the dirt-collection chamber.

* * * * *